United States Patent [19]

Bechard et al.

[11] 4,281,274

[45] Jul. 28, 1981

[54] DISCHARGE LAMP HAVING VITREOUS SHIELD

[75] Inventors: Conrad E. Bechard, Moreland Hills; John M. Davenport, Lyndhurst; Denis A. Lynch, Jr., South Euclid, all of Ohio

[73] Assignee: General Electric Co., Schenectady, N.Y.

[21] Appl. No.: 62,717

[22] Filed: Aug. 1, 1979

[51] Int. Cl.[3] ..... H01J 7/44; H01J 17/34; H01J 19/78; H01K 1/62

[52] U.S. Cl. ..... 315/49; 313/190; 313/207; 313/219; 315/46

[58] Field of Search ..... 313/110, 112, 184, 190, 313/207, 205, 206, 219; 315/49, 92, 46

[56] References Cited

U.S. PATENT DOCUMENTS

| | | | |
|---|---|---|---|
| 3,134,920 | 5/1964 | Van de Weijer | 313/112 |
| 3,424,935 | 1/1969 | Gungle et al. | 313/184 |
| 3,484,637 | 12/1969 | Van Boort et al. | 313/219 X |
| 3,609,437 | 9/1971 | Taeketol et al. | 313/184 |
| 3,780,331 | 12/1973 | Knochel et al. | 313/219 |
| 3,995,928 | 12/1976 | Shaffner et al. | 313/184 |
| 4,151,445 | 4/1979 | Davenport et al. | 315/92 |

*Primary Examiner*—Saxfield Chatmon, Jr.
*Attorney, Agent, or Firm*—Ernest W. Legree; Lawrence R. Kempton; Philip L. Schlamp

[57] ABSTRACT

A jacketed metal halide discharge lamp combining a miniature arc tube containing sodium iodide and a standby filament within an outer envelope, is provided with a glass sleeve around the arc tube. The glass sleeve is preferably connected to a point of potential which is positive relative to the arc tube, suitably the anode when the arc is operated on d.c. The glass sleeve prevents sodium loss from the arc by trapping ultraviolet light and by shielding the arc from photoelectrons. The sleeve serves also to reduce color shift when the arc tube is switched over from "high" to "low", and to protect the outer bulb in the event of arc tube rupture.

9 Claims, 3 Drawing Figures

DISCHARGE LAMP HAVING VITREOUS SHIELD

The invention relates to a jacketed metal halide discharge lamp, and more particularly to a lamp or lighting unit combining a miniature arc tube with a standby filament within an outer envelope and which may be used to achieve instant lighting. It is more immediately concerned with a vitreous shield which surrounds the arc tube and prevents sodium loss while protecting the outer bulb in the event of arc tube rupture.

BACKGROUND OF THE INVENTION

The present invention is of particular value in a lighting unit designed for functional similarity to an incandescent lamp and wherein the principal source of light is a miniature high pressure metal vapor arc lamp supplemented by a standby filament. The unit includes a compact high frequency power supply for achieving the needed energization and regulation from a conventional 100 volt, 60 Hertz electric supply. An example of such a power supply is described in U.S. Pat. No. 4,151,445—Davenport and Diamond, Instant Light Lamp Control Circuit, Apr. 24, 1979. The arb tube may be a miniature metal halide discharge lamp having a volume less than 1 cc and an input rating from 100 watts to as low as 10 watts. By following the design principles taught in pending application of Cap and Lake, Ser. No. 912,628, filed June 5, 1978, titled "High Pressure Metal Vapor Discharge Lamps of Improved Efficacy", which is assigned like this application, arc tube efficacies are achieved equal to those formerly obtainable only in lamps of ratings of 175 watts or more.

The miniature metal halide arc tube forming part of the lighting unit contains sodium iodide as one of its fill ingredients, as do substantially all commercially available metal diode arc lamps. The loss of sodium atoms by the movement of $Na^+$ ions through the hot silica of the walls in sodium-containing lamps is well-known. The loss of sodium atoms from NaI frees iodine which can then combine with the mercury in the arc tube to form $HgI_2$ and this leads to many difficulties such as hard starting and change in color of the emitted radiation. Reference may be made to Electric Discharge Lamps by Waymouth, M.I.T. Press 1971, Chapter 10 for a detailed description of the sodium loss process in metal iodide arc lamps. The solution to the problem which has been adopted by the major lamp manufacturers in the U.S. has been the so-called "frameless" harness as taught in Pat. No. 3,424,935—Gungle et al, 1969, Harness Construction for Metal Arc-Type Lamp. There is good evidence that most of the sodium loss is due to a negative charge on the arc tube walls caused by photoelectric emission from the frame side rods used to support the arc tube within the outer bulb in prior art construction. In the "frameless" construction, there are no side rods running alongside the arc tube and the current return wire for the outer end electrode is a fine piece of tungsten wire, sometimes known as the flying lead, spaced as far away from the arc tube as possible and hugging the curve or bulge in the outer bulb.

SUMMARY OF THE INVENTION

In a compact lamp or lighting unit comprising a miniature arc tube within an outer bulb, the "frameless" harness solution to the sodium loss problem presents difficulties. Particularly in a lamp which includes within the outer bulb in addition to the miniature arc tube at least one filament for standby lighting and possibly a second filament for ballasting the arc tube, the "frameless" construction is quite impractical.

The object of the invention is to provide, in a lamp of the foregoing kind, a practical and economical way of preventing sodium loss.

Another object is to provide in a lighting unit having a "high" mode and a "low" mode of operation, a shield which can be used to improve the efficacy and the light color of the arc tube in the dim mode.

A further object is to provide a shield which will protect the outer bulb in the event of arc tube rupture.

In accordance with the invention, we provide around the arc tube a vitreous enclosure transmissive of visible light but opaque to ultraviolet light and open to the atmosphere of the outer bulb which contains a nonreactive gas, suitably nitrogen. The vitreous enclosure may conveniently be a hard glass cylinder encircling and overlapping the bulbous portion of the arc tube. Preferably the vitreous enclosure is supported by wire leads or conductors which are connected to a point which is positive in potential relative to the arc tube.

In a preferred embodiment intended for a lighting unit which includes a standby filament and a ballasting filament and wherein the arc tube is operated on rectified alternating current, the vitreous enclosure is a borosilicate glass sleeve which can withstand a high temperature without softening. The sleeve is supported by metal leads embedded in the glass and fastened to a wire support electrically connected to the anode of the arc tube. At its normal operating temperature, the glass sleeve is sufficiently conductive that it operates as a positively biased electric shield surrounding the arc tube and repelling $Na^+$ ions back into the arc tube.

DETAILED DESCRIPTION

Figure 1:
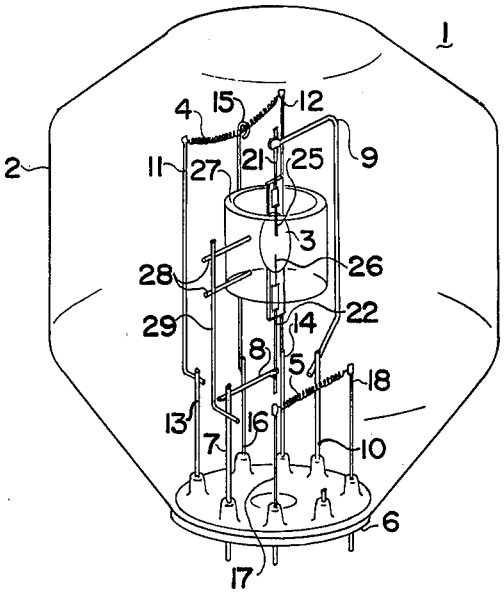
FIG. 1 shows pictorially a lamp embodying the invention and comprising arc tube, main and auxiliary filaments within an outer bulb and a glass sleeve surrounding the arc tube and supported by leads electrically connected to the anode.

Referring to the drawing, an instant lighting unit or lamp 1 embodying the invention is illustrated comprising an outer glass envelope or bulb 2 within which are mounted an inner envelope or arc tube 3, a main tungsten filament 4 and an auxiliary tungsten filament 5. The outer bulb is provided at its lower end with a disc like glass closure 6 through which inleads extend hermetically. Inlead 7 having cross support 8 joined to it connects to the lower electrode of the arc tube; support wire 9 joined to inlead 10 connects to the upper electrode and together they support arc tube 3 in a vertical or axial attitude approximately at the center of the outer bulb. Main filament 4 is mounted across support wires 11, 12 which are attached to inleads 13, 14, respectively, and provide an offset of the filament to the side away from the center of the outer bulb. Filament 4 is additionally supported near its midpoint by a brace 15 attached to inlead 16 and having its end formed into a loop encircling the filament. The auxiliary filament 5 is mounted across the ends of inleads 17, 18 formed into clamps.

The space within outer bulb 2 is filled with an inactive gas such as nitrogen to prevent oxidation of the filaments or of the fine arc tube inleads 21, 22 which are very hot at the points where they emerge from the quartz.

The arc tube 3 is typical of the discharge envelope proper of a high efficiency miniature metal halide lamp such as disclosed in the aforementioned Cap and Lake application. It is made of quartz or fused silica, suitably by the expansion and upset of quartz tubing while heated to plasticity and revolving in a glass lathe. The bulb portion may be formed by momentarily pressurizing the tubing, while the neck portions 23, 24 may be formed by reducing the internal pressure and allowing the quartz tubing to neck down through the surface tension. By way of example, the wall thickness of the bulb portion may be about 0.5 mm, the internal diameter about 6 mm, and the arc chamber volume approximately 0.11 cc. Electrodes 25, 26 are positioned on the axis of the arc tube with their distal ends defining an interelectrode gap of 3 mm in this example. The electrodes 25, 26 are joined to the inleads 21,22 by foliated portions, preferably of molybedenum, which are wetted by the fused silica of the necks to assure hermetic seals. By way of example, a suitable filling for a lamp of the illustrating size having a rating of 30 to 35 watts comprises argon at a pressure of 100 to 120 torr, 4.3 mg of Hg, and 2.2 mg of halide salt consisting of 85% NaI, 5% $ScI_3$ and 10% $ThI_4$ by weight. Such quantity of mercury, when totally vaporized under operating conditions, will provide a density of about 39 mg/cm$^3$ which corresponds to a pressure of about 23 atmospheres at the operating temperature of the lamp.

A characteristic of miniature high pressure metal vapor lamps is the very rapid deionization to which they are subject. In operation on 60 Hz alternating current, deionization is almost complete between half cycles so that a very high restriking voltage is required to be provided by the ballast. In order to avoid such requirement, it is preferable to operate miniature metal halide lamps on high frequency ballasts or, alternatively, on unidirectional current obtained by rectifying a.c. As regards high frequency operation, there are resonance-free regions in the range of 20 to 50 kHz wherein stable operation is possible as taught in copending application Ser. No. 864,578, filed Dec. 27, 1977, by John M. Davenport, titled "High Frequency Operation of Miniature Metal Vapor Discharge Lamps", assigned to the same assignee as the present invention. The type of circuit favored for such high frequency operation, frequently termed an inverter in general comprises a power oscillator with current limiting means coupled to the miniature arc lamp and control means for assuring instant lighting through a standby filament, as shown for example in U.S. Pat. No. 4,151,445, Davenport and Diamond, "Instant Light Lamp Control Circuit", April 1979.

Figure 2:
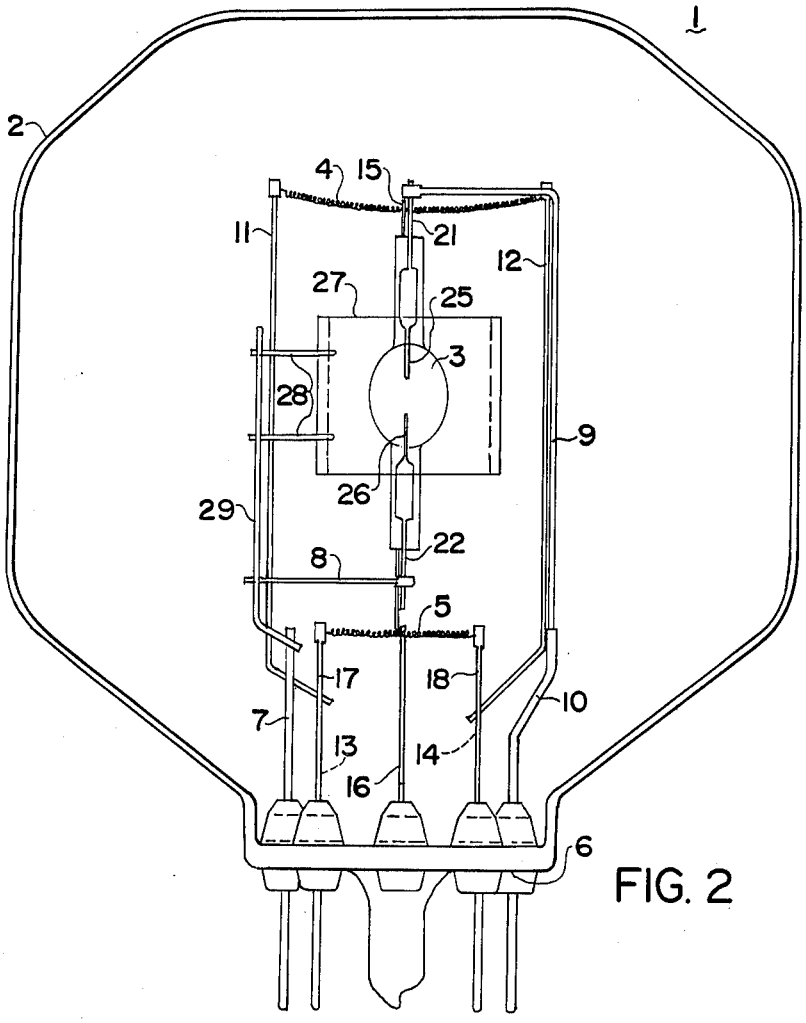
FIG. 2 is a sectional view of the same lighting unit to a larger scale.
Figure 3:
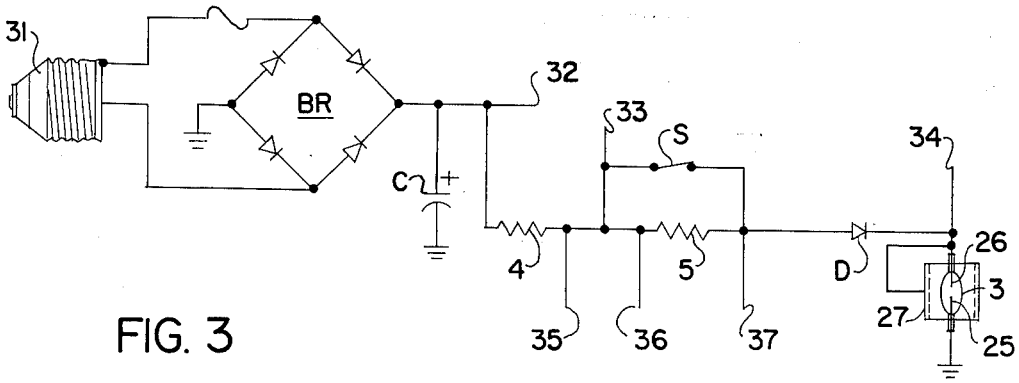
FIG. 3 is a simplified schematic circuit diagram of a d.c. operating and ballasting circuit for the lighting unit.

For unidirectional current operation when the starting point is the usual 120 v, 60 Hz alternating current supply, the type of circuit included in the lighting unit comprises a d.c. power supply and an operating circuit for the arc tube and the standby filament. An example of such a circuit is given in copending application of Peil and McFadyen, Ser. No. 47,972, filed June 13, 1979, entitled "Lighting Unit" (35 EL 1465), assigned like this application. The circuit is shown in simplified form in FIG. 3 and comprises a conventional d.c. power supply including a bridge rectifier BR energized from the usual 120 volts, 60 hertz supply via an Edison screw base 31, and a storage capacitor C for reducing voltage ripple in the full wave rectified output. The three "grounds" shown in the circuit have been so shown for ease of illustration and merely represent common connections; they do not represent the grounded side of the usual 120 v., 60 hertz supply. The arc tube operating circuit, proceeding from the positive side of storage capacitor C, comprises in series main filament 4, auxiliary filament 5, a diode D and anode 26 of arc tube 3. The cathode 25 of the arc tube is connected to the indicated ground. (The cathode is shown lowermost in the schematic of FIG. 3 whereas it is in fact uppermost as shown in FIGS. 1 and 2.) On "high", the switch S is closed as shown and the current through the arc tube is limited only by main filament 4; on "low", switch S is open and both main filament 4 and auxiliary filament 5 are in series and limit the current to a lower value. Main filament 4 may correspond approximately to the filament of a 120 v., 60 watt bulb, while auxiliary filament 5 may correspond to that of a 120 v., 40 watt bulb. Connections 32, 33 and 34 go to an inductor-capacitor network, while connections 35, 36 and 37 go to a solid state switching network fully described in the above-mentioned Peil and McFadyen application. The circuit provides d.c. current to filament 4 (and 5 if in circuit) and to arc tube 3 in series during warm-up and normal operation. At other times, current is coupled in pulsating form to main or standby filament 4 for the production of standby light, and in alternating form to the input of the network for starting the arc tube. The d.c. power supply and operating circuit may be contained in a small case to which glass bulb 2 is attached and which carries the Edison screw base 31 for insertion into a conventional lamp socket.

For d.c. operation, the arc tube 3 is provided with a cathode electrode 25 and an anode electrode 26 and it is oriented to put the cathode uppermost as illustrated in FIGS. 1 and 2. The cathode may comprise a helical coil of tungsten wire terminating in a rounded tip as described in copending application of Dvorak and Fridrich, Ser. No. 973,182, filed Dec. 26, 1978, entitled "Electrode for A High Pressure Metal Vapor Lamp" and assigned like this application. The anode may be simply a tungsten wire with a balled end.

In a lamp as illustrated, our invention provides a novel solution to the usual problem of sodium loss from a fused silica arc tube containing sodium iodide. A vitreous enclosure open to the nitrogen atmosphere of outer bulb 2 is provided around arc tube 3, and is supported by conductors which are at a positive potential relative to the arc tube when averaged over time. As shown, the vitreous enclosure is a short sleeve 27 of hard glass encircling and overlapping at both ends the bulbous portion of the arc tube. A preferred glass is borsilicate glass which can withstand without softening temperatures will in excess of the range from 200° C. to 400° C. to which the sleeve is subjected in operation. The resistivity of the glass falls rapidly with rising temperature, as shown by the following table.

TABLE 1

| Temperature | Resistivity |
|---|---|
| 0° C. | $3.0 \times 10^{19}$ ohm-cms |
| 100° C. | $5.2 \times 10^{15}$ ohm-cms |
| 200° C. | $2.4 \times 10^{10}$ ohm-cms |
| 250° C. | $1.6 \times 10^{8}$ ohm-cms |
| 350° C. | $2.5 \times 10^{7}$ ohm-cms |

As seen, over the operating temperature range from about 200° C. up to 400° C., the resistivity is less than $2.4\times10^{10}$ ohm-cms, and this is low enough to assure a reasonably constant surface potential in the presence of the small photoelectric current encountered in a lamp. Electrical conduction in the glass is by alkali ion hopping, and when a photoelectron strikes the sleeve, it will combine with a surface alkali ion to form a free metal (Na or K) atom. In the operating temperature range of the sleeve, the probability of an atom leaving the glass is relatively low. More probable is a migration of the electron from alkali ion to alkali ion through the glass until it encounters the metal leads 28 and is conducted away.

The leads 28 through which sleeve 27 is supported are embedded in the glass. They are preferably of an alloy which matches the glass in coefficient of thermal expansion, for instance of Kovar, an alloy of iron, nickel and cobalt. Lead wires 28 are attached to vertical support wire 29 which in turn is attached to inlead 7, the attachments being by welding or in any other suitable manner. Inlead 7 is connected to the lower electrode 26 which is the anode of arc tube 3. If one takes as the potential of the arc tube the mean of the anode and cathode voltages, it is seen that the support leads of shield 27 are effectively at a positive potential above the mean of the arc tube, signal to half the arc tube voltage drop. At the usual operating temperature of the shield in the range of 300° to 400° C., the borosilicate glass has sufficient conductivity that the potential of the shield becomes substantially that of inlead 7 and the anode of the arc tube in which it is connected.

The connection of the glass shield to the anode as illustrated is important. If the connection should be reversed, that is the shield should be connected instead to inlead 10 or support wire 9 which are connected to the cathode, the shield would be put at a negative potential below the mean of the arc tube equal to half the arc tube voltage drop. In such case a rapid loss of sodium from the arc tube takes place, as is evidenced by the voltage rise and the development after a few hundred hours of operation of a beet red color at one end of the arc tube. Such color is indicative of the presence of mercury iodide $HgI_2$, which is formed by the reaction of mercury with iodine freed from NaI by the loss of sodium atoms from the arc tube. If the loss of sodium is allowed to continue, it leads to hard starting and change in color of the emitted radiation toward blue. When the glass sleeve is supported from the anode lead as shown in the drawings, there is little voltage rise and no formation of $HgI_2$ has been observed. If the glass sleeve is supported from an insulated lead, the results are not as good as when supported from the anode lead. Table 2 below compares the arc tube volts at 10 and at 500 hours for cathode and anode connections and confirms the foregoing.

TABLE 2

| Arc Tube | Volts at 10 Hours | Volts at 500 Hours | Δ Volts | Visible $HgI_2$ In Arc Tube |
|---|---|---|---|---|
| | Sleeve Connected To Cathode | | | |
| #1956 | 75.5 | 89.3 | +13.8 | Yes |
| #1957 | 84.0 | 88.2 | + 4.2 | Yes |
| #1960 | 79.9 | 90.1 | +10.2 | Yes |
| #1962 | 74.9 | 80.4 | + 5.5 | Yes |
| | | Avg. | + 8.4 | |
| | Sleeve Connected To Inode | | | |
| Arc Tube | Volts At 10 Hours | Volts At 500 Hours | Δ Volts | Visible $HgI_2$ In Arc Tube |
| #1964 | 77.0 | 79.3 | +2.3 | |
| #1966 | 79.2 | 81.3 | +2.1 | |
| #1967 | 80.8 | 77.2 | −3.6 | |
| #1969 | 78.6 | 86.3 | +7.7 | |
| #1970 | 80.8 | 76.8 | −4.0 | |
| #1971 | 78.8 | 78.8 | 0 | |
| | | Avg. | +0.75 | |

The effectiveness of a simple glass shield in preventing or reducing sodium loss is surprising and it is believed to be due to two factors operating together. The generally accepted view is that sodium loss from an arc tube occurs when electrons are allowed to charge the surface of the quartz arc tube negatively. Waymouth, earlier cited, has attributed the generation of electrons to ultraviolet radiation from the arc tube striking metal parts such as the side rods or conductors within the outer envelope and causing the emission of photoelectrons. If this view be accepted, the glass shield would be effective firstly by obstructing and trapping the ultraviolet radiation inasmuch as borosilicate glass is substantially opaque to ultraviolet, and secondly by providing a positively charged electric field which attracts any photoelectrons and prevents them from reaching the surface of the arc tube. By reason of the first effect, it appears reasonable that some benefit to achieved when the shield is merely supported by an insulated lead. However the connection of the shield to the anode side of the arc tube is necessary for the second effect in order to realize the full benefit of our invention. In an arrangement where the arc tube is operated on alternating current, the sleeve may be maintained at a potential which on a time-average is positive relative to the arc tube, by the simple expedient of interposing a properly poled diode in the connection between the shield and one of the electrodes.

In a lightening unit having two levels of brightness such as the present one, glass sleeve 27 is also useful to improve the color of the light produced by the arc tube during the "low" mode of operation. In the "low" mode, the arc tube tends to run cooler so that less of the metal halide is vaporized, and this causes a shift in color toward blue. With a glass sleeve around the arc tube, the temperature drop from "high" mode to "low" mode is less and this reduces the extent of color shift occurring at switch-over.

Finally, the sleeve is useful as a means to protect the outer bulb from flying fragments in the event of arc tube rupture. The combined pressure of the vaporized mercury and metal iodides within the arc tube may be as high as 30 atmospheres, depending upon the design and the color temperature of light desired. Notwithstanding great care in manufacture, it may happen occasionally that an arc tube containing some hidden flaw is produced which in time ruptures under the operating pressure. In such event, the glass sleeve serves to confine the fragments from the arc tube and prevents rupture of the outer bulb.

What we claim as new and desire to secure by Letters Patent of the United States is:

1. A lamp comprising:

an arc tube within an outer glass bulb having inleads sealed thereinto, said arc tube being made of vitreous material transmissive of ultraviolet radiation and containing a filling of mercury and metal halide including sodium iodide and serving as the main light source in said lamp, said outer bulb having metal members within it extending from said inleads and supporting said arc tube, and an enclosure of glass substantially opaque to ultraviolet radiation surrounding said arc tube and open to the atmosphere of said outer bulb, said enclosure being of glass having substantial conductivity at its operating temperature in said lamp and being connected to a point maintained at a potential which on average is positive relative to said arc tube.

2. A lamp as in claim 1 including at least one filament within said outer bulb operable as a standby light source, said filament extending between metal support members attached to said inleads.

3. A lamp as in claim 1 wherein said arc tube has anode and cathode and is operated on d.c., and said enclosure is a glass sleeve having substantial conductivity in the temperature range of 200° C. to 400° C. at which it operates in said lamp, said glass sleeve being connected to said anode.

4. A lamp as in claim 3 including at least one ballasting filament within said outer bulb connected in series between a d.c. supply inlead and said arc tube, said filament extending between metal support members attached to said inleads.

5. A lamp comprising:

an arc tube located within an outer glass bulb having inleads sealed thereinto at one end, said arc tube being made of vitreous material transmissive of ultraviolet radiation and containing a filling of mercury and metal halide including sodium iodide and serving as the main light source in said lamp, said outer bulb containing at least one incandescible filament serving as a standby light source and metal support members for said arc tube and incandescible filament extending from said inleads, an enclosure of light-transmissive vitreous material substantially opaque to ultraviolet radiation surrounding said arc tube and open to the atmosphere of said outer bulb, and metallic supports for said enclosure connected to a point of potential which on average is positive relative to said arc tube during operation.

6. A lamp as in claim 5 wherein said arc tube is a miniature arc tube having a volume less than 1 cc.

7. A lamp as in claim 5 wherein said arc tube is a miniature arc tube made of quartz and having a bulbous portion less than 1 cc in volume, and said enclosure is a glass sleeve overlapping said bulbous portion at both ends.

8. A lamp as in claim 5 wherein said arc tube has anode and cathode and is operated on d.c. and said glass sleeve is connected to said anode.

9. A lamp as in claim 8 wherein said filament is connected in series between a d.c. supply inlead and said arc tube and serves to ballast the arc tube in normal operation.

* * * * *